US005369844A

United States Patent [19]

Locatelli et al.

[11] Patent Number: 5,369,844

[45] Date of Patent: Dec. 6, 1994

[54] METHOD AND DEVICE FOR CONTROLLING A COMBING MACHINE

[75] Inventors: Claudio Locatelli; Gian M. Baitelli, both of Palazzolo Sull'Oglio, Italy

[73] Assignee: Industrie Meccanotessili Marzoli S.r.l., Bergamo, Italy

[21] Appl. No.: 70,809

[22] Filed: Jun. 3, 1993

[30] Foreign Application Priority Data

Jun. 3, 1992 [IT] Italy ..... MI92 A 001362

[51] Int. Cl.[5] ..... D01G 31/00; D01G 19/08; D01G 19/16

[52] U.S. Cl. ..... 19/0.20; 19/115 R; 19/215; 318/626

[58] Field of Search ..... 318/626, 466; 19/0.20, 19/0.21, 115 R, 215, 223, 225

[56] References Cited

U.S. PATENT DOCUMENTS

| | | | |
|---|---|---|---|
| 2,895,177 | 7/1959 | Foster | 19/223 |
| 4,403,180 | 9/1983 | Tsuboshima | 318/626 X |
| 4,831,318 | 5/1989 | Yuasa et al. | 318/626 |
| 4,987,648 | 1/1991 | Clement | 19/0.20 X |
| 5,017,850 | 5/1991 | Harada et al. | 318/626 X |
| 5,022,122 | 6/1991 | Clement | 19/225 |
| 5,095,586 | 3/1992 | Wüsr et al. | 19/115 R |

FOREIGN PATENT DOCUMENTS

| | | |
|---|---|---|
| 0437807 | 12/1990 | European Pat. Off. . |
| 0455171 | 4/1991 | European Pat. Off. . |
| 432312 | 10/1965 | Switzerland . |
| 485873 | 10/1967 | Switzerland . |

*Primary Examiner*—Clifford D. Crowder
*Assistant Examiner*—John J. Calvert
*Attorney, Agent, or Firm*—Diller, Ramik & Wight

[57] ABSTRACT

The position of the gripper unit in a combing machine is monitored, and when the machine is to be halted its stoppage is controlled such that the machine halts always and only when the gripper unit is at its point of maximum opening or maximum closeness to the grabbing rollers. A position sensor (35) is associated for example with the rocker arm (18) which operates the gripper unit and provides pulses at each rocking movement of the arm (18). When the machine motor (27) is to be halted a braking action is produced by a brake (36) after a predetermined time or after measuring a certain number of pulses from the sensor (35) or on measuring a determined time interval between pulses, so as to effectively halt the machine with the gripper unit open.

18 Claims, 3 Drawing Sheets

METHOD AND DEVICE FOR CONTROLLING A COMBING MACHINE

BACKGROUND OF THE INVENTION

This invention relates to a method and device for controlling a combing machine.

Fibre combing in a combing machine is known to involve a plurality of synchronously operated members. The actual combing is effected cyclically by a circular comb, the toothed portion of which penetrates between the tufts of the fibre cloth while this is engaged between the elements of the gripper unit during rearward movement and also partly during advancement. The teeth of the circular comb remove the individual ungripped fibres to produce a combed web, the removed fibres being discarded. Coordination of these and other moving machine members is achieved mechanically by transmissions and crank mechanisms which receive motion from a single electric motor.

If the machine is stopped for any reason, although synchronization between the various moving members is not lost the product being processed may suffer negative effects. In this respect, the condition of the fibres may be such that on re-starting the machine an excessive discarding of material occurs. A combing discontinuity or irregularity can therefore result, leading to a loss in quality of the web leaving the machine.

Re-starting the machine generally requires the assistance of personnel to reset the combing conditions and if necessary act to remedy processing defects. This results in cost increase.

An object of the present invention is to overcome the difficulties connected with the stoppage of a combing machine by improving the quality and uniformity of the web following machine stoppage and reducing the discarding of material during machine re-starting.

A further object is to provide a method and device for controlling a combing machine which maintains combing continuity and reduces the time involved by personnel during machine re-starting.

SUMMARY OF THE INVENTION

These objects are attained according to the present invention by a method for controlling a combing machine in which a fibre cloth is subjected cyclically to the action of a circular comb and of a gripper unit which retains the fibre cloth during combing, the fibre cloth being temporarily released from the action of the gripper unit when the combing action by the circular comb ceases, characterised in that the stoppage of the machine is controlled such that the machine is halted always and only when the gripper unit is substantially in its position of maximum opening or maximum advancement.

Advantageously in the method of the invention, the inertial deceleration of the machine is monitored and on attaining a determined reduction in its speed of movement a braking action is produced to halt the machine substantially when the gripper unit is in its position of maximum opening or maximum advancement. The method of the invention is implemented by a control device in a combing machine in which the members involved in the combing are operated by a motor via transmissions and crank mechanisms, and a gripper unit arranged to temporarily grip a fibre cloth cooperates with a circular comb arranged to comb the fibre cloth during the gripping of the fibre cloth by the gripper unit, characterised in that position sensor means are associated with the gripper unit, said sensor means being operationally connected to a halting device which on the basis of the sensing by said sensor means is caused to halt the machine substantially when the gripper unit is in its position of maximum opening or maximum advancement.

According to a preferred embodiment of the invention, the halting device comprises a brake operated after a determined number of rocking movements of the rocking drive means for the gripper unit, as measured by said sensor means starting from a halt signal fed to said motor.

With a method and device of this kind, the machine is halted each time in a position in which the combing members are always in the same operating state, namely in a position in which these are not acting on the fibre cloth and the gripper unit is completely open. In this respect, it has been found that this situation gives the best conditions for re-starting the machine and hence the combing, in which there are no damaging effects on the fibres, and combing continuity and hence product quality are maintained. On re-starting production from said halt conditions it has been found that a lesser quantity of material has to be discarded, so increasing machine efficiency. The personnel requirement during re-starting can also be limited because of the advantageous re-start conditions, which are always the same given that the machine is halted always and only when the grippers are completely open or at maximum advancement.

Further details and advantages of the invention will be more apparent from the following description of a preferred embodiment of the invention, which is illustrated by way of non-limiting example on the accompanying drawings, in which:

DESCRIPTION OF THE PREFERRED EMBODIMENTS

Figure 1:
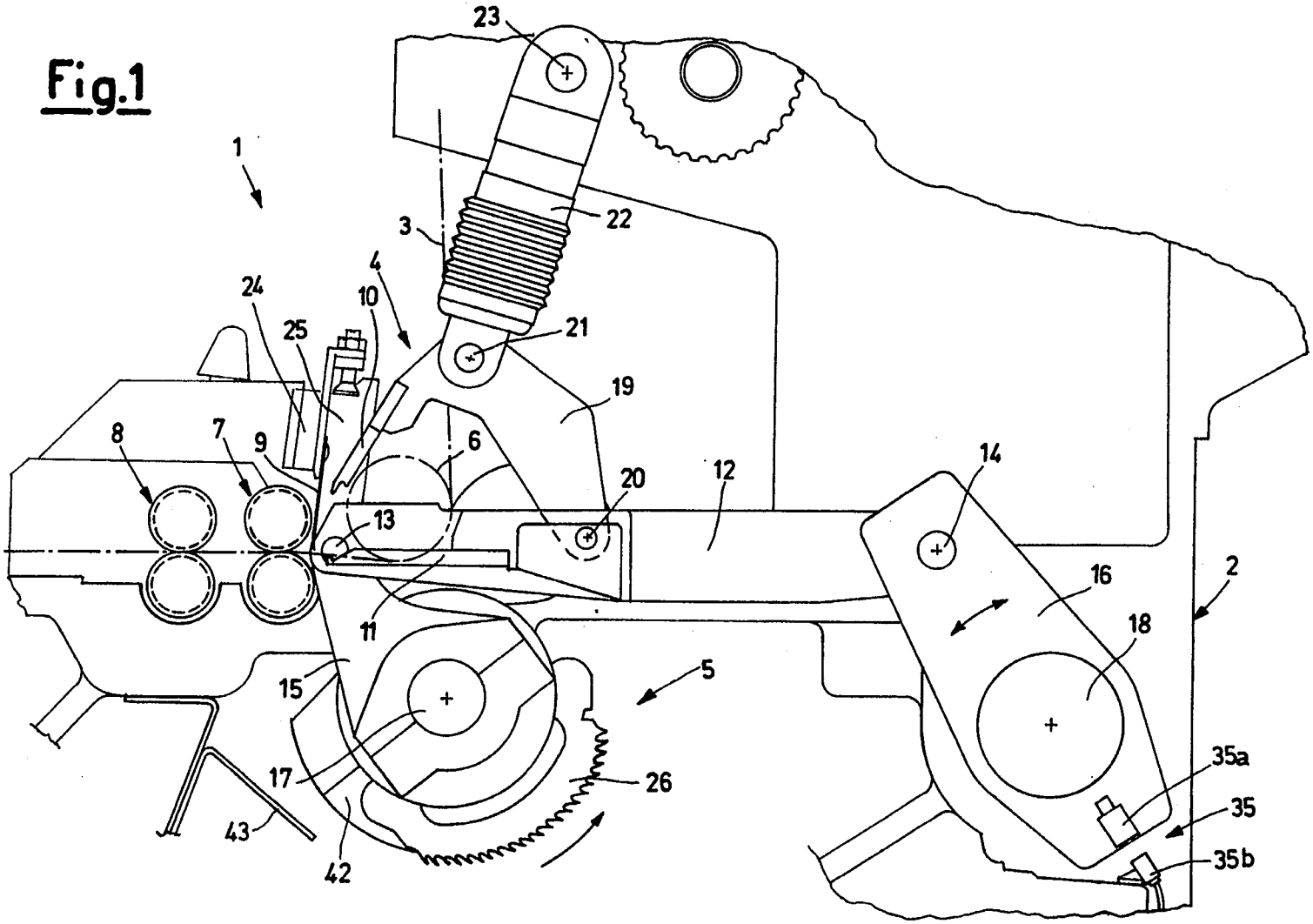
FIG. 1 is a side elevation of the essential members involved in combing in a combing machine, shown during the stage of maximum opening or maximum advancement of the gripper unit.

With reference to said figures, a combing machine 1 with a fixed frame 2 comprises, in known manner, means (not shown) for feeding a fibre cloth 3 to the combing members, consisting essentially of a gripper unit 4 cooperating with a circular comb 5. A feed roller 6 guides the fibre cloth 3 within the combing region, while grabbing rollers 7 and 8 move the combed web forwards and rearwards synchronously with the action of the combing members. A rectilinear comb 9 cooperates in the combing action in known manner.

The gripper unit 4 comprises essentially an upper gripper element 10 and a lower gripper element 11. This latter is fixed to a bar 12 pivoted at points 13 and 14 at its ends to rocker arms 15 and 16 respectively, these being supported by shafts 17 and 18. The arm 16, rigid with the shaft 18, is driven with rocking movement in known manner. The arm 15 is supported idly on the shaft 17. The upper gripper arm 10 is fixed to an arm 19 pivoted at 20 to the bar 12 and at 21 to an expandable element 22 pivoted at 23 to the fixed structure 2.

Figure 2:
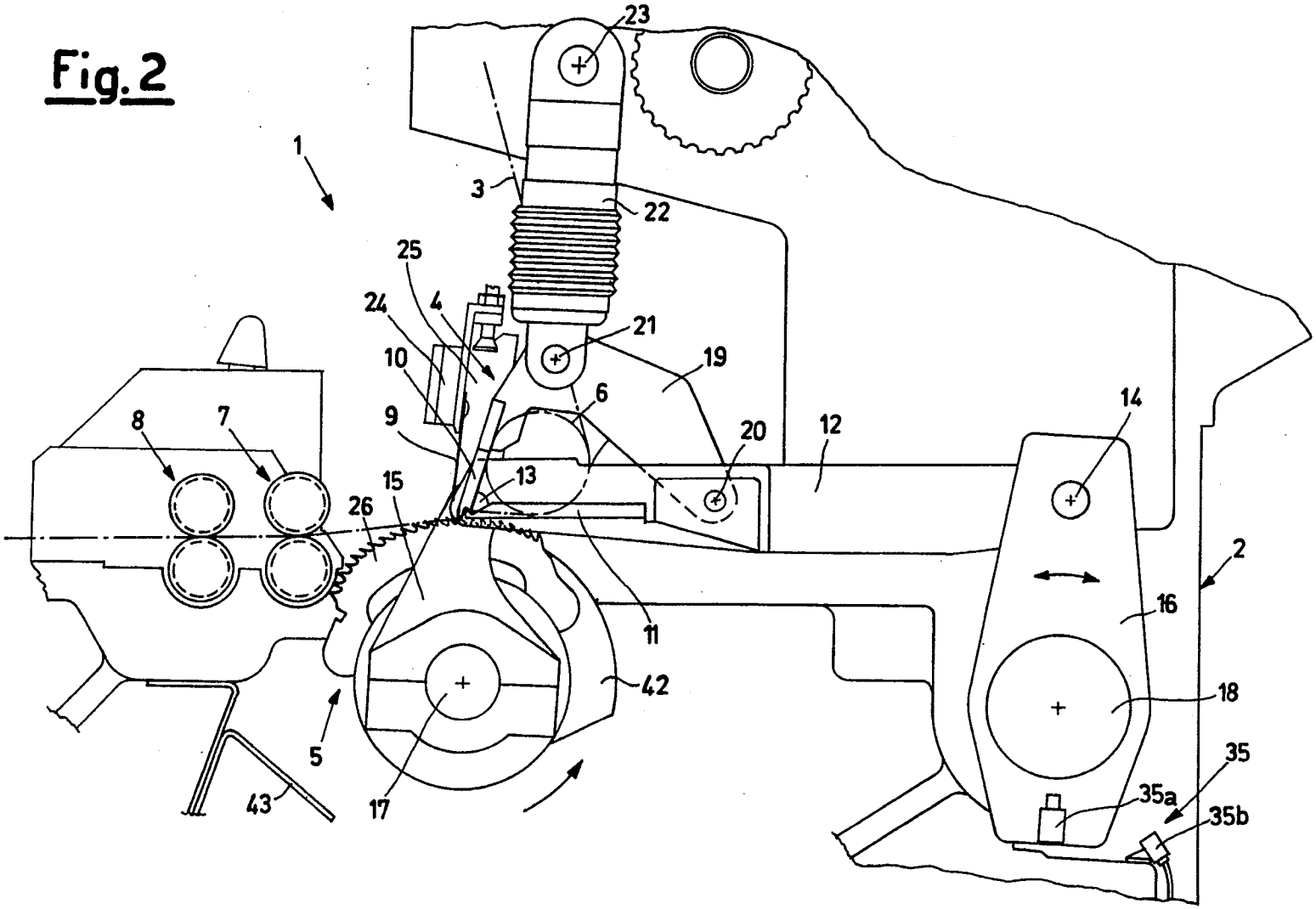
FIG. 2 is a view similar to that of FIG. 1, but showing the gripper unit closed and moving rearwards, with combing underway.

The rectilinear comb 9 is fixed by a block 24 to a support 25 rigidly fixed in known manner to the bar 12. The circular comb 5 is rigid with the shaft 17 and comprises a toothed sector 26 of known type. The angular arrangement of the toothed sector 26, ie the angular position in which the circular comb 5 is fixed onto the shaft 17, is such that the fibre cloth 3 is engaged during combing when the gripper unit 4 is closed and moving rearwards, as indicated in FIG. 2.

Figure 3:
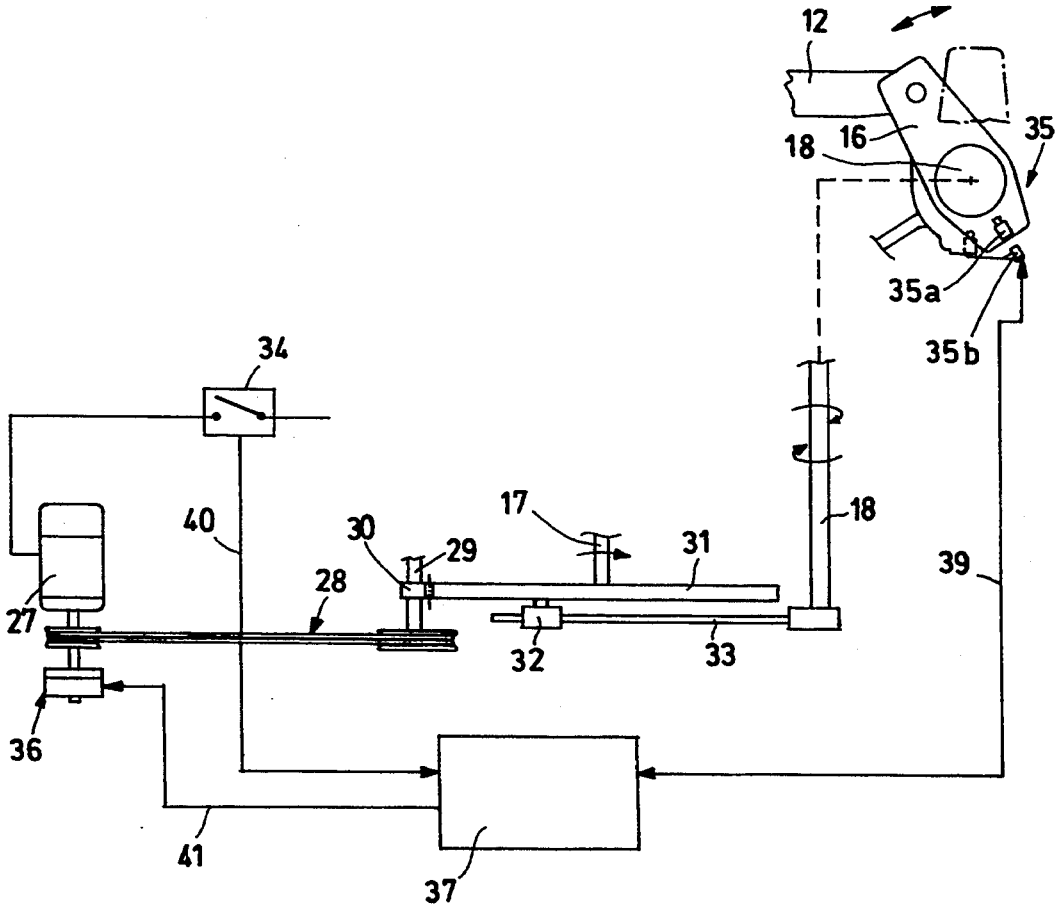
FIG. 3 shows a functional scheme of the device according to the invention.

The moving members of the machine are driven by an electric motor 27 (FIG. 3), which by way of a belt drive/and pulleys rotates a first shaft 29, on which a pinion 30 is keyed to engage a gear wheel 31 fixed to the shaft 17. The shaft 29 transmits movement to certain machine members in known manner, while the shaft 17 rotates the circular comb 5 and transmits movement to the grabbing rollers 7 and 8 in known manner.

On the gear wheel 31 there is eccentrically pivoted a sleeve within which there longitudinally slides a rod 33, its end distant from the sleeve 32 being fixed to the shaft 18. Rotation of the gear wheel 31 hence results in angular rocking of the shaft 18 and with it the rocker arm 16 to operate the gripper unit 4. This crank-type operating system is well known and results in the fibre cloth 8 being cyclically subjected to the action of the circular comb 5 and to the action of the gripper unit 4 which retains the cloth during combing (FIG. 2), this then being temporarily released from the action of the gripper unit 4 when the combing action ceases (FIG. 1).

According to the invention the stoppage of the machine, consequent on the opening of a switch 34 which interrupts power to the motor 27, is controlled such that the machine stops always and only when the gripper unit 4 is substantially in its position of maximum opening or of maximum advancement.

For this purpose, the gripper unit 4 comprises associated position sensor means, consisting preferably of a sensor 35 for sensing the position of the rocker arm 16, which are operationally connected to a halting device/controlled by an electronic control unit 37 on the basis of the determination by said sensor means such as to halt the machine when the gripper unit 4 is in its completely open position.

In the illustrated embodiment, the sensor 35 comprises a confronting element 35*a* and a magnetic sensor element 35*b*, one fixed to the arm 16 operating the gripper unit 4 and the other fixed to the machine fixed structure 2 so that they face each other when the gripper unit 4 is in its open position, as shown in FIG. 1. One of the magnetic elements acts as a magnetic field generator and the other as an impedance. During the rocking of the arm 16, the element 35*a* causes cyclic variations in the magnetic field of the element 35*b* with a frequency corresponding to the frequency with which the confronting element 35*a* passes in front of the element 35*b*. These cyclic variations are transformed into electrical signals or pulses, which are fed to the control unit 37 via the line 39. The elements 35*a* and 35*b* are preferably positioned so that they face each other when the gripper unit 4 is in its position of maximum opening.

When the machine is operating normally the sensor means are either disconnected or the relative signals are ignored by the control unit 37, as it is not operative. When the machine is halted by opening the switch 34, the control unit 37 is made operative by receiving an activation signal via the line 40 which connects it to the switch 34.

As the machine does not stop instantaneously but gradually because of the inertia of the moving members, the rocker arm 16 undergoes a few more rocking movements, which are sensed by the sensor 35 and fed in the form of signals or pulses to the control unit 37. On attaining a determined reduction in the speed of movement or a determined number of pulses counted by the unit 37, a braking action is produced by feeding a rapid braking signal through the line 41 to the halting device 36, which can advantageously be an electromagnetic brake, so as to halt the machine when the gripper unit 4 is in its open state.

This condition can be achieved in various ways. Knowing the normal time which the machine takes to stop by inertia from the moment the switch 34 is opened or the machine stop button is operated, the brake 36 can be operated a determined time after the machine halt command (opening of the switch 34) has been given, or when the control unit 37 has received a predetermined number of pulses from the sensor 35 corresponding to a determined number of rocking movements of the means which operate the gripper unit 4, ie when the machine is almost at rest and the braking action applied by the brake results in instantaneous stoppage. In this case the stop signal is provided by the control unit 37 just prior to a new signal from the sensor 35, so that effective stoppage is achieved with the elements 35*a* and 35*b* facing each other, this position corresponding to maximum opening of the gripper unit 4 in accordance with FIG. 1.

As the pulses received by the unit 37 from the sensor 35 follow each other not with a constant time gap but with a gap which gradually increases, the control unit 37 can be programmed to measure the time between successive pulses, and to feed the stop signal to the brake 36 when after measuring a predetermined time between one pulse and the next a time has passed since this latter pulse which when added to the time required for the braking action to effectively halt the machine corresponds to the time at which the unit 37 would receive the next pulse.

Again, the brake 36 could act as soon as the control unit 37 is made operative, the braking action being proportioned so that effective stoppage is achieved when the elements 35*a* and 35*b* of the position sensor 35 are aligned.

It should be noted that the position in which the machine stops does not necessarily have to coincide exactly with that of maximum opening or advancement of the gripper unit 4. A certain tolerance in the opening of the grippers is admissible, provided that the combed fibres are superimposed on those previously combed.

A sensor of another type, such as a proximity sensor or optical sensor, could be used instead of a magnetic position sensor.

As can be seen in FIGS. 1 and 2, the circular comb 5 comprises an appendix 42 extending through a certain arc downstream (in the direction of rotation of the comb) of the toothed sector 26 and having a radius slightly less than the radius of the toothed sector 26. When the gripper unit 4 is in its position of maximum opening (FIG. 1), the appendix 42 faces a wall 43 very close to it. When in this position the appendix 42 and the fixed wall 43 substantially restrict the suction area below the fibres. This restriction causes a substantial reduction in the suction action, which would otherwise be of constant intensity. This prevents the fibres being deviated towards the suction region during the gripper opening, so ensuring correct combing action.

In addition to the aforesaid advantages, the method and device of the invention have the advantage of reducing the machine down-time and increasing machine efficiency, because of lesser problems during re-starting. The method and device of the present invention can also be easily applied to combing machines already in use.

The position sensor can also be associated with the gripper unit in a manner different from that shown, for example it can be associated with the bar 12.

Although a preferred embodiment of the invention has been specifically illustrated and described herein, it is to be understood that minor variations may be made in the apparatus without departing from the spirit and scope of the invention, as defined the appended claims.

What is claimed is:

1. A method of controlling the operation of a combing machine which includes a cooperable circular comb and a gripper unit comprising the steps of subjecting fibre cloth to alternating fibre combing and fibre releasing action by the cooperative alternating movement of the gripper unit respectively toward and away from the circular comb, and deactivating the operation of the combing machine only when the gripper unit is at a position of substantially maximum spacing away from the circular comb.

2. The method as defined in claim 1 including the steps of monitoring inertial deceleration of the machine, and braking the machine upon monitoring a predetermined reduction in machine speed to deactivate machine operation only when the gripper unit is at its position of substantially maximum spacing away from the circular comb.

3. The method as defined in claim 1 comprising the steps of creating the alternating movement of the gripper unit by imparting rocking movement to the gripper unit, initiating a machine operation deactivation signal, measuring the number of rocking movements of the gripping unit starting from the movement the machine operation deactivation signal is given, and producing a braking action when a predetermined number of rocking movements has been reached to deactivate the operation of the combing machine only when the gripper unit is at a position of substantially maximum spacing away from the circular comb.

4. The method as defined in claim 1 comprising the steps of initiating a machine operation deactivation signal, measuring the passage of time from the moment the machine operation deactivation signal is initiated, and producing a braking action when a predetermined time has been measured to deactivate the operation of the combing machine only when the gripper unit is at a position of substantially maximum spacing away from the circular comb.

5. The method as defined in claim 1 comprising the steps of creating the alternating movement of the gripper unit by imparting rocking movement to the gripper unit, creating pulses corresponding to rocking movements of the gripper unit, measuring the time between successive pulses during gripper unit inertial deceleration, and producing a braking action when the time between one pulse and a next pulse is equal to a predetermined time and a time has passed from said next pulse which when added to the time required for effectively deactivating the operation of the machine corresponds to the time at which a subsequent pulse would be created.

6. The method as defined in claim 1 comprising the steps of initiating a machine operation deactivation signal, and producing a braking action upon the initiation of the machine operation deactivation signal proportional to effect machine operation deactivation only when the gripper unit is at its position of substantially maximum spacing away from the circular comb.

7. Apparatus for controlling the operation of a combing machine which includes a cooperable circular comb and a gripper unit comprising means for subjecting fibre cloth to alternating fibre combing and fibre releasing action by the cooperative alternating movement of a gripper unit respectively toward and away from a circular comb, and means for deactivating the operation of the combing machine only when the gripper unit is at a position of substantially maximum spacing away from the circular comb.

8. The apparatus as defined in claim 7 including means for monitoring inertial deceleration of the machine, and means for braking the machine upon said monitoring means monitoring a predetermined reduction in machine speed to deactivate machine operation only when the gripper unit is at its position of substantially maximum spacing away from the circular comb.

9. The apparatus as defined in claim 7 wherein said subjecting means creates the alternating movement of the gripper unit by imparting rocking movement to the gripper unit, means for initiating a machine operation deactivation signal, means for measuring the number of rocking movements of the gripping unit starting from the movement the machine operation deactivation signal is given, and means for producing a braking action when a predetermined number of rocking movements has been reached to deactivate the operation of the combing machine only when the gripper unit is at a position of substantially maximum spacing away from the circular comb.

10. The apparatus as defined in claim 7 including means for initiating a machine operation deactivation signal, means for measuring the passage of time from the moment the machine operation deactivation signal is initiated, and means for producing a braking action when a predetermined time has been measured to deactivate the operation of the combing machine only when the gripper unit is at a position of substantially maximum spacing away from the circular comb.

11. The apparatus as defined in claim 7 including means for creating the alternating movement of the gripper unit by imparting rocking movement to the gripper unit, means for creating pulses corresponding to rocking movements of the gripper unit, means for measuring the time between successive pulses during gripper unit inertial deceleration, and means for producing a braking action when the time between one pulse and a next pulse is equal to a predetermined time and a time has passed from said next pulse which when added to the time required for effectively deactivating the operation of the machine corresponds to the time at which a subsequent pulse would be created.

12. The apparatus as defined in claim 7 including means for initiating a machine operation deactivation signal, and means for producing a braking action upon the initiation of the machine operation deactivation signal proportional to effect machine operation deactivation only when the gripper unit is at its position of substantially maximum spacing away from the circular comb.

13. The apparatus as defined in claim 7 including sensing means for sensing the position of said gripper unit relative to said circular comb and generating a control signal corresponding thereto, and control means responsive to a predetermined control signal generated by said sensing means for operating said deactivating means.

14. The apparatus as defined in claim 13 wherein said subjecting means creates alternating movement of the gripper unit by imparting rocking movement to said gripper unit, and said sensing means senses the number of rocking movements of the gripper unit for operating said deactivating means.

15. The apparatus as defined in claim 14 wherein said deactivating means includes braking means.

16. The apparatus as defined in claim 13 wherein said sensing means is a magnetic sensor.

17. The apparatus as defined in claim 13 wherein said sensing means is a proximity sensor.

18. The apparatus as defined in claim 13 wherein said sensing means is a an optical sensor.

* * * * *